United States Patent [19]

Kawaguchi et al.

[11] Patent Number: 4,761,979

[45] Date of Patent: Aug. 9, 1988

[54] ROLLER BENDING APPARATUS EQUIPPED WITH A CURVATURE MEASURING UNIT

[75] Inventors: Kenji Kawaguchi, Osaka; Akio Yoshida, Amagasaki, both of Japan

[73] Assignee: Mitsubishi Denki Kabushiki Kaisha, Japan

[21] Appl. No.: 942,061

[22] Filed: Dec. 15, 1986

Related U.S. Application Data

[63] Continuation of Ser. No. 738,750, May 29, 1985, abandoned.

[30] Foreign Application Priority Data

| | | | |
|---|---|---|---|
| May 30, 1984 | [JP] | Japan | 59-108664 |
| Sep. 29, 1984 | [JP] | Japan | 59-205037 |
| Feb. 18, 1985 | [JP] | Japan | 60-29796 |
| Feb. 18, 1985 | [JP] | Japan | 60-29797 |

[51] Int. Cl.[4] ..... B21D 5/14

[52] U.S. Cl. ..... 72/9; 72/173

[58] Field of Search ..... 72/9, 12, 15, 17, 34, 72/702, 170, 173; 33/178 E, 178 D, 551, 552

[56] References Cited

U.S. PATENT DOCUMENTS

| | | | |
|---|---|---|---|
| 3,459,018 | 8/1969 | Miller | 72/702 |
| 3,854,215 | 12/1974 | Foster | 72/9 |
| 3,906,765 | 9/1975 | Foster | 72/9 |
| 4,080,815 | 3/1978 | Foster | 72/173 |

FOREIGN PATENT DOCUMENTS

| | | | |
|---|---|---|---|
| 2912640 | 9/1980 | Fed. Rep. of Germany | 33/556 |
| 19988 | 8/1969 | Japan | 72/173 |
| 3779 | 1/1977 | Japan | 33/178 D |

OTHER PUBLICATIONS

Goodwin, L. E., "A Differential Transformer Gauge for Outside and Inside Diameters of Long Tubes", from E. I. du Pont de Nemours and Co. Report DP-263, Jan., 1958, (Instruments/TID-4500, 13th Ed., Suppl.), pp. 1-15.

"Closed-Loop Shape Control of a Roll-Bending Process", from Journal of Dynamic Systems, Measurement and Control, Hardt et al, Dec. 1982 vol. 104, pp. 317-322.

"Modelling of Elastic-Plastic Bending of Beams Using a Roller Bending Machine" Hansen et al, Aug. 1979 vol. 101, from Transactions of the ASME, pp. 304-310.

*Primary Examiner*—Daniel C. Crane

*Attorney, Agent, or Firm*—Leydig, Voit & Mayer

[57] ABSTRACT

A three-roller bending apparatus having a movable top roller and two stationary bottom rollers has a curvature measuring unit for automatically measuring the radius of curvature of a workpiece being bent and for displaying the measured value for an operator. The curvature measuring unit comprises three probes, at least one of which is a movable probe whose displacement produces an electrical output signal while the remaining probes are stationary. The probes are made to contact the surface of a workpiece, and the electrical output signal is applied to a calculating and display unit which calculates the radius of curvature of the workpiece and displays the result. The apparatus may further comprise a CPU which automatically controls both the rolling of the workpiece and the operation of the curvature measuring unit and determines when to terminate rolling based on the output of the curvature measuring unit. The apparatus may also have auxiliary rollers which press the workpiece against the bottom rollers, making it possible for the bottom rollers to move the workpiece even when a gap develops between the workpiece and the top roller.

1 Claim, 10 Drawing Sheets

ROLLER BENDING APPARATUS EQUIPPED WITH A CURVATURE MEASURING UNIT

This application is a continuation of application Ser. No. 738,750, filed May 29, 1985, now abandoned.

BACKGROUND OF THE INVENTION

The present invention relates to a roller bending apparatus for forming metal stock. More particularly but no exclusively, it relates to a three-roller bending apparatus in which the curvature of the material being rolled can be automatically measured and in which the rolling process can be automatically controlled so as to achieve a finished product having a desired curvature.

Three-roller bending involves imposing a bending moment on a material at the same time that the material is being rolled between two lower rollers and a top roller, the bending moment being applied through the top roller which can be moved up and down by suitable means and the driving force for moving the material being provided by the lower rollers which are driven by motors. Generally, control of the shape of the material is performed manually. Namely, after each stage of rolling, an operator compares the shape of the material being rolled with a template and then adjusts the position of the top roller accordingly, relying largely on his experience and on intuition. This method is time-consuming and inaccurate, being subject to error on the part of the operator. In addition it requires the manufacture of a large number of templates, since different templates are necessary every time a workpiece having a different curvature is to be rolled.

Furthermore, a highly trained operator is necessary to adjust the setting of the top roller based on the measured shape of the material because it is very difficult to predict the relationship between a given roller position and the resulting shape of the material after rolling.

A different problem encountered in three-roller bending is that a gap may develop between the top roller and the material being rolled due to the fact that the end portions of a material being rolled remain straight during rolling. Since the bottom rollers can not transport the material unless the top roller presses the material from above, such a gap makes it impossible for the material to be moved and rolling can not take place. The top roller must then be further lowered until it contacts the workpiece, but by further lowering of the top roller, the workpiece may end up being overbent and therefore unusable.

SUMMARY OF THE INVENTION

It is therefore an object of the present invention to provide a three-roller bending apparatus which can automatically measure the curvature of a material being rolled, making it unnecessary for an operator to manually check the curvature of the material with templates.

It is another object of the present invention to provide a three-roller bending apparatus which can automatically perform roller bending of a variety of materials and shapes.

It is another object of the present invention to provide a three-roller bending apparatus which can effectively roll a material even when a gap develops between the material and the top roller of the apparatus.

In a three-roller bending apparatus according to the present invention, two bottom rollers rotated by drive motors for supporting a workpiece are provided beneath a top roller which can be moved in the vertical direction towards the bottom rollers. A curvature measuring unit is provided which automatically measures the radius of curvature of the workpiece being rolled and produces a corresponding electrical output signal which is provided to a calculating and display unit which calculates the radius of curvature based on the electrical output signal and displays the measured value for an operator. The curvature measuring unit comprises at least three probes mounted on a probe holder, at least one of the probes being a moving probe whose linear displacement produces a corresponding electrical output signal, with the rest of the probes being stationary probes. A drive cylinder of the curvature measuring unit moves the probe holder towards the workpiece until all of the probes firmly contact the surface of the workpiece, in which state the electrical output signal is applied to the calculating and display unit.

The apparatus may further comprise a CPU which calculates the size of the stroke of the top roller necessary to achieve a desired radius of curvature of the workpiece based on input values provided by an operator. The CPU controls the rolling of the workpiece and the measurement of its radius of curvature by the curvature measuring unit so that rolling can be automatically performed.

The apparatus may further comprise auxiliary rollers provided opposite each of the bottom rollers of the apparatus so as to press the workpiece against the bottom rollers and enable the bottom rollers to move the workpiece even when a gap exists between the workpiece and the top roller.

BRIEF DESCRIPTION OF THE DRAWINGS

In all of the drawings, the same reference numerals indicate the same or corresponding parts.

DESCRIPTION OF THE PREFERRED EMBODIMENTS

Figure 1:
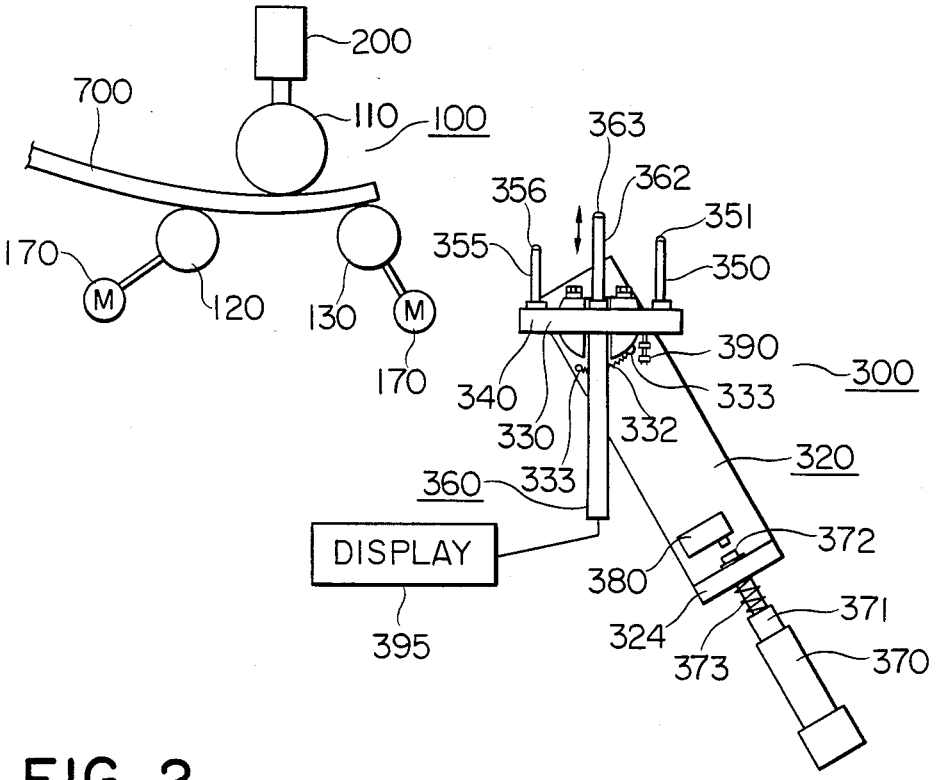
FIG. 1 is a front elevation of a first embodiment of a three-roll bending apparatus according to the present invention.

A first embodiment of a three-roller bending apparatus according to the present invention will now be described while referring to FIGS. 1 through 4 of the accompanying drawings. As shown in FIG. 1, the bending apparatus comprises a roller portion 100 by which a workpiece 700 is rolled, a motor 200 which moves the top roller of the roller portion 100 up and down and applies a bending moment to the workpiece 700, and a curvature measuring unit 300 which automatically measures the radius of curvature of the workpiece 700 and displays the result of measurement.

The roller portion 100 comprises a top roller 110 which can be moved in the vertical direction and two stationary bottom rollers 120 and 130. The bottom rollers 120 and 130 are rotated by drive motors 170, while the top roller 110 is a follower roller which is rotated by the movement of the workpiece 700. As shown in the figure, the three rollers are disposed in the shape of a pyramid, with the lines connecting their centers forming an isosceles triangle. The top roller 110 is moved in the vertical direction by a servomotor 200. Instead of a servomotor, a stepping motor, a hydraulic ram, or other suitable means may be used to move the top roller 110.

Figure 3:
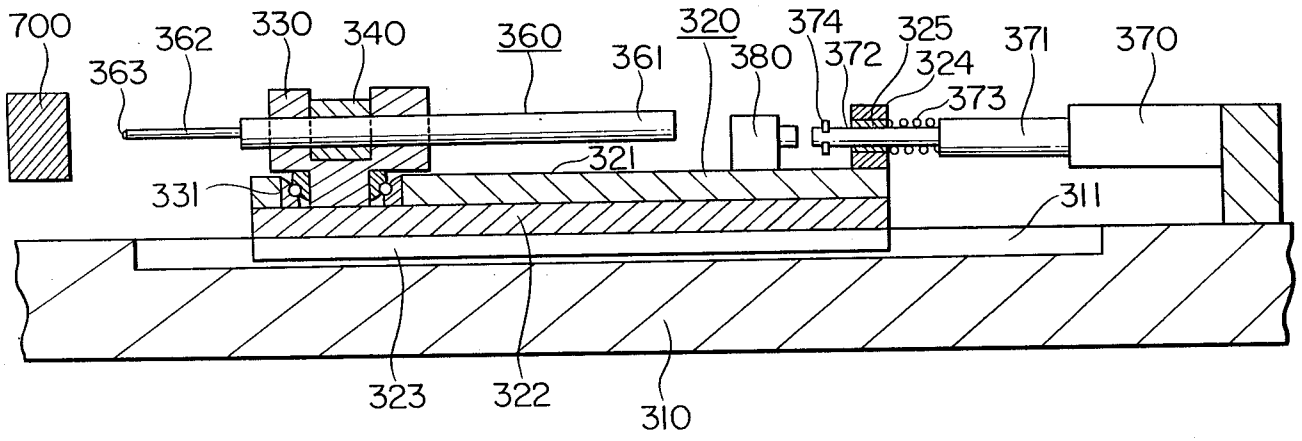
FIG. 3 is a a longitudinal cross-sectional view of the main portion of the curvature measuring unit of FIG. 1.
Figure 4:
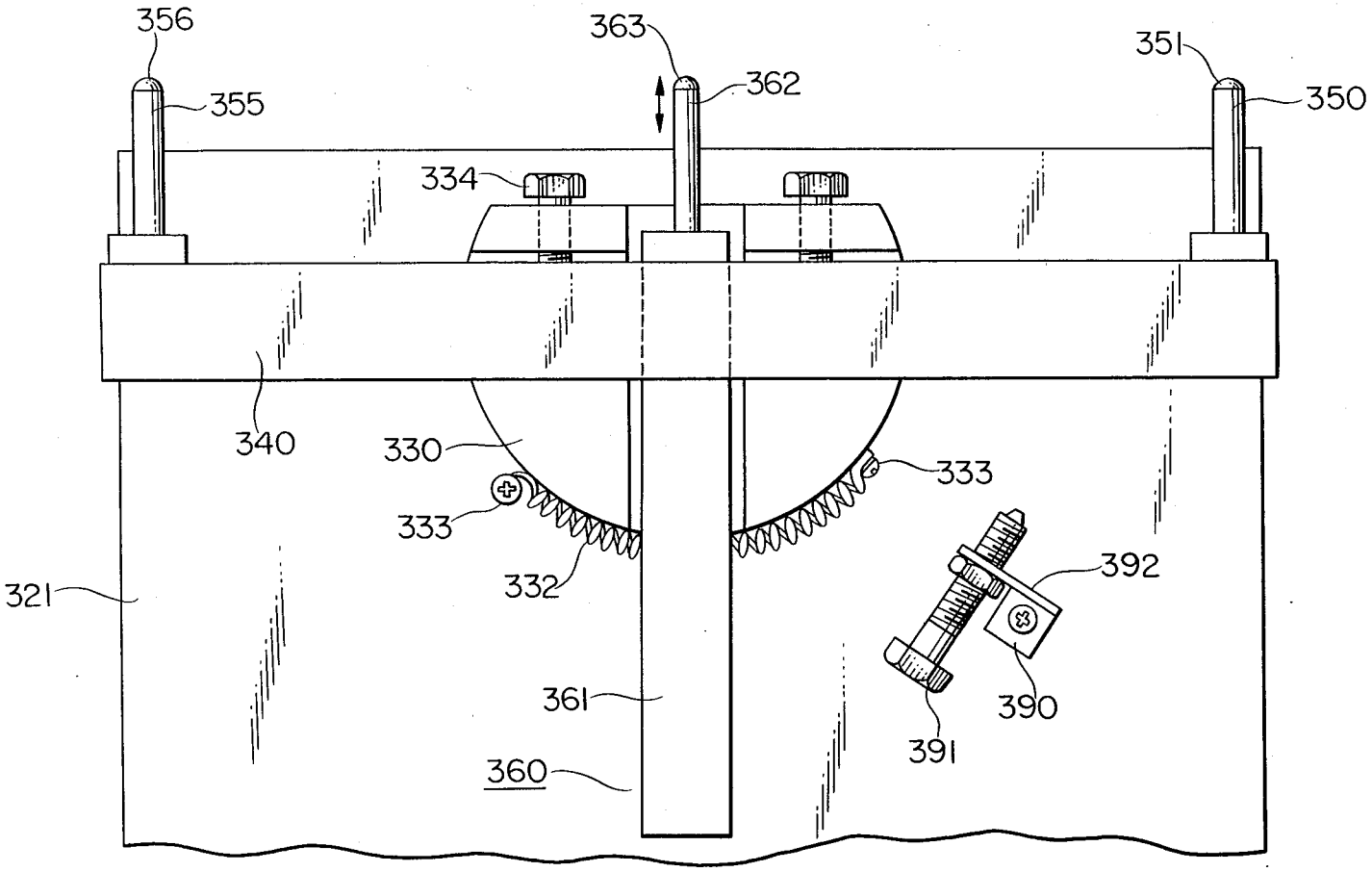
FIG. 4 is an enlarged front elevation of the end portion of the curvature measuring unit of FIG. 2.

The structure of the curvature measuring unit 300 is shown in most detail in FIGS. 3 and 4. The purpose of this unit is to accurately measure the radius of curvature of a workpiece being bent by the roller portion 100 and to display the result of measurement for an operator. A stationary main frame 310 (see FIG. 3) supports a translating frame 320 which can be moved in a straight line along the main frame 310 towards and away from the roller portion 100. The translating frame 320 comprises an upper plate 321 rigidly secured to a lower plate 322 which has a key 323 which can slide in a straight keyway 311 formed in the main frame 310.

The upper plate 321 of the translating frame 320 rotatably supports a rotating jig 330 by a roller bearing 331 mounted on the top plate 321.

The rotating jig 330 rigidly supports a probe holder 340 which is held in the jig 330 by set screws 334 which screw into holes in the jig 330 and abut against one surface of the probe holder 340. A first stationary probe 350 is rigidly mounted on one end of the probe holder 340, and an identical second stationary probe 355 is rigidly mounted on the opposite end of the probe holder 340. Each of the stationary probes 350 and 355 comprises a cylindrical rod having one end secured to the probe holder 340 and having a contact 351 or 356 secured to the other end. In the illustrated embodiment, the contacts are steel balls, but a knife-edge contact or a pointed contact may of course be used instead.

Midway between the stationary probes 350 and 355, a displacement meter 360 is provided. The displacement meter 360 has a cylindrical housing 361 which is rigidly secured to the probe holder 340. The housing 361 supports a moving probe 362 in a manner such that the moving probe 362 can be moved in the axial direction of the housing 361 in the direction indicated by the arrows when a force is applied to its outer end. An unillustrated spring contained inside the housing 361 normally pushes the moving probe 362 outwards so as to extend beyond the probe holder 340 by at least the same amount as the stationary probes 350 and 355, but when a force is applied to the outer end of the probe 362, the probe 362 is pushed into the housing 361 against the force of the spring and an unillustrated sensor such as a differential transformer contained inside the housing 361 detects the linear displacement of the moving probe 362 and produces an electrical output signal corresponding to the displacement. Like the stationary probes 350 and 355, the moving probe 362 comprises a cylindrical rod having a contact 363 made from a steel ball secured to its outer end. All three of the probes are disposed so as to lie in the same plane parallel to the plane of the upper plate 321.

The rotating jig 330 is supported by the roller bearing 331 so as to be able to rotate in a plane parallel to the plane of the upper plate 321 of the translating frame 320. However, as shown in FIG. 4, its rotation in the clockwise direction is limited by a rotation limiter 390 comprising a frame 392 rigidly secured to the upper plate 321 by a screw and a set screw 391 which is supported by the frame 392 and abuts against the side of the probe holder 340 when the rotating jig 330 rotates in the clockwise direction, preventing its further rotation. A biasing spring 332 is secured between the upper plate 321 and the side of the rotating jig 330 by screws 333. The spring 332 exerts a clockwise torque on the rotating jig 330 so that when no force is applied to the second stationary probe 355, the rotating jig 330 will rotate until the side of the probe holder 340 firmly rests against the set screw 391 of the rotation limited 390.

A drive cylinder 370 is rigidly secured to the main frame 310 at the end opposite from the roller portion 100. The drive cylinder 370 should be controllable in response to an electrical input signal, but the way in which the drive cylinder 370 produces force is not important. It may be electrically, pneumatically, or hydraulically powered. The drive cylinder 370 has a ram 371 which it causes to move back and forth in the direction of the roller portion 100. A slender rod 372 is secured to the outer end of the ram 371. This rod 372 is supported by a journal bearing 325 formed in the center of a rod guide plate 324 which is rigidly mounted on one end of the upper plate 321 so that the rod 372 can slide back and forth through the rod guide plate 324 in the direction of the roller portion 100. A compression spring 373 is concentrically disposed around the outside of the rod 372 between the end surface of the ram 371 and one side of the rod guide plate 324 so that when the ram 371 is moved outwards by the drive cylinder 370, a force will be applied to the translating frame 320 through the rod guide plate 324, causing the translating frame 320 to move towards the roller portion 100. The compression spring 373 has a higher spring constant than the unillustrated spring provided within the housing 361 which pushes the moving probe 362 outwards.

A limit ring 374 is rigidly secured to the outer end of the rod 372 to prevent the rod 372 from passing through the rod guide plate 324. A limit switch 380 is rigidly secured to the top plate 321 of the translating frame 320 in the vicinity of the rod guide plate 324 so as to confront the outer end of the rod 372. The limit switch 380 is electrically connected to the drive cylinder 370 such that when the end of the rod 372 contacts the limit switch 380, the operation of the drive cylinder 370 is stopped.

A calculating and display unit 395 is electrically connected to the displacement meter 360 so as to receive the electrical output signal from the displacement sensor contained within the housing 361 as an input signal. Based on the level of this signal, the calculating and display unit 395 calculates the radius of curvature of the workpiece 700 and displays the value.

Figure 2:
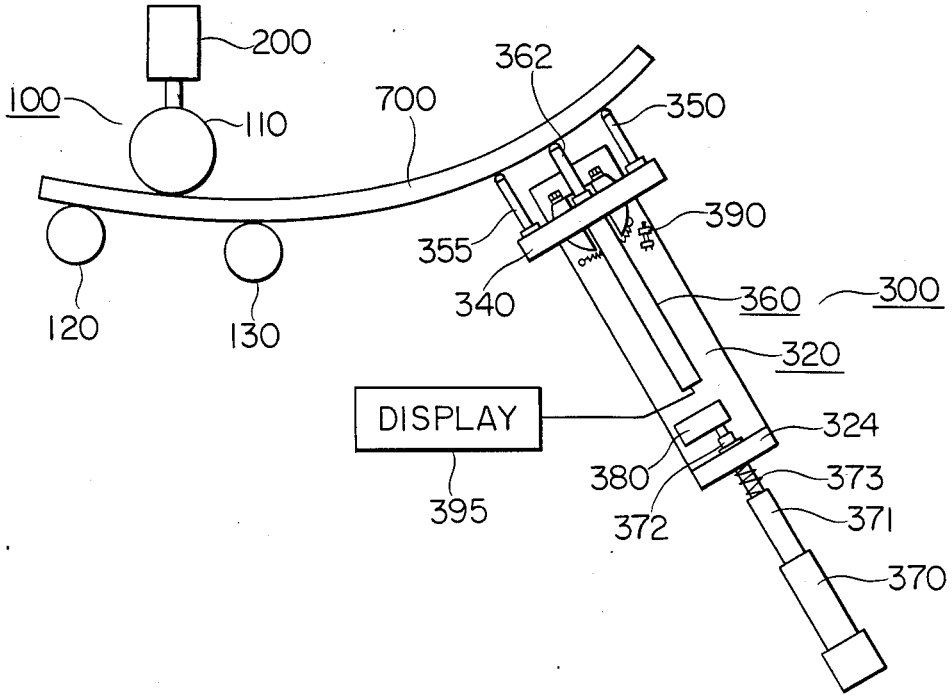
FIG. 2 is a front elevation of the embodiment of FIG. 1, showing the curvature measuring unit being used to measure the curvature of a workpiece.

The operation of this embodiment will now be described while referring to FIGS. 1 and 2. FIG. 1 is a front view showing the state of the apparatus when rolling is about to take place. The ram 371 of the drive cylinder 370 is retracted and the translating frame 320 of the curvature measuring unit 300 is pulled downwards to the lower end of the main frame 310 (not shown in FIGS. 1 and 2) by gravity so as not to impede the movement of the workpiece 700. The translating frame 320 is supported from below by the compression spring 373 which is selected to be strong enough to support the weight of the translating frame 320 while still maintaining a gap between the outer end of the rod 372 and limit switch 380. The bottom rollers 120 and 130 are rotated by the drive motors 170 in the clockwise direction, and the workpiece 700 is rolled from left to right in the figure, undergoing bending deformation due to the bending moment applied to it by the top roller 110. When the workpiece 700 has passed through the rollers, the drive motors 170 for the bottom rollers 120 and 130 are stopped by the operator or by suitable automatic means so that the right end of the workpiece will extend beyond the right-hand bottom roller 130 as shown in FIG. 2. The operator then turns on the drive cylinder 370, causing the ram 371 to extend upwards towards the workpiece 700. The translating frame 320 will be moved upwards together with the ram 373 while being guided by the keyway 311 in the main frame 310. During this upward movement, the outer end of the rod 372 will remain separated from the limit switch 380 and the limit switch 380 will not be activated.

When the translating frame 320 reaches the vicinity of the workpiece 700, the left-hand stationary probe 355 will contact the surface of the workpiece 700, and as the ram 371 continues to move the translating frame 320 upwards, a counterclockwise torque will be exerted on the rotating jig 330 through the stationary probe 355. The rotating jig 330 will then be caused to rotate counterclockwise against the torque applied by the biasing spring 332 until it reaches the situation shown in FIG. 2 in which both of the stationary probes 350 and 355 firmly contact the surface of the workpiece 700. At the same time, the moving probe 362 will be caused to retract into the housing 361 by the force applied to it by the surface of the workpiece 700. However, the internal spring contained within the housing 361 will still apply an outwards force to the probe 362, that it, too, will firmly contact the workpiece 700.

As mentioned above, the spring constant of the compression spring 373 is greater than that of the spring contained within the housing 361, so that even though the moving probe 362 is pushed against the surface of the workpiece 700, the ram 371 of the drive cylinder 370 will still be able to advance. However, as the stationary probes 350 and 355 now prevent the translating frame 320 from any further movement by their contact with the workpiece 700, the further extension of the ram 371 will cause it to approach the rod guide plate 324, and the rod 372 will be caused to extend towards the limit switch 380 until it contacts the latter and operates it. The limit switch 380 will then provide an electrical output signal to the drive cylinder 370 which stops its motion and maintains it in the position shown in FIG. 2.

The calculating and display unit 395 will then calculate the radius of curvature of the workpiece 700 based on the input signal from the displacement meter 360 and display the curvature for the operator to see. As the lengths of the stationary probes 350 and 355, the original length of the moving probe 362, and the displacement of its tip as indicated by the input signal from the displacement meter 360 are known, the curvature of the workpiece 700 can be calculated by conventional calculating means using a simple algorithm.

After viewing the results of measurement, the operator then retracts the ram 371 of the drive cylinder 370 so as to return the translating frame 320 to its original position shown in FIG. 1. Based on the results, the operator can then determine whether to increase the stroke of the top roller 110 and perform another stage of rolling, or whether the desired curvature has been obtained and the workpiece 700 can be removed from the rollers.

It is clear that with this embodiment, measurement of the radius of curvature of a workpiece can be performed much more easily and accurately than with a conventional roller bending apparatus requiring the use of templates. Therefore, not only is the measurement procedure itself improved, but the need for manufacturing templates is done away with.

Figure 5:
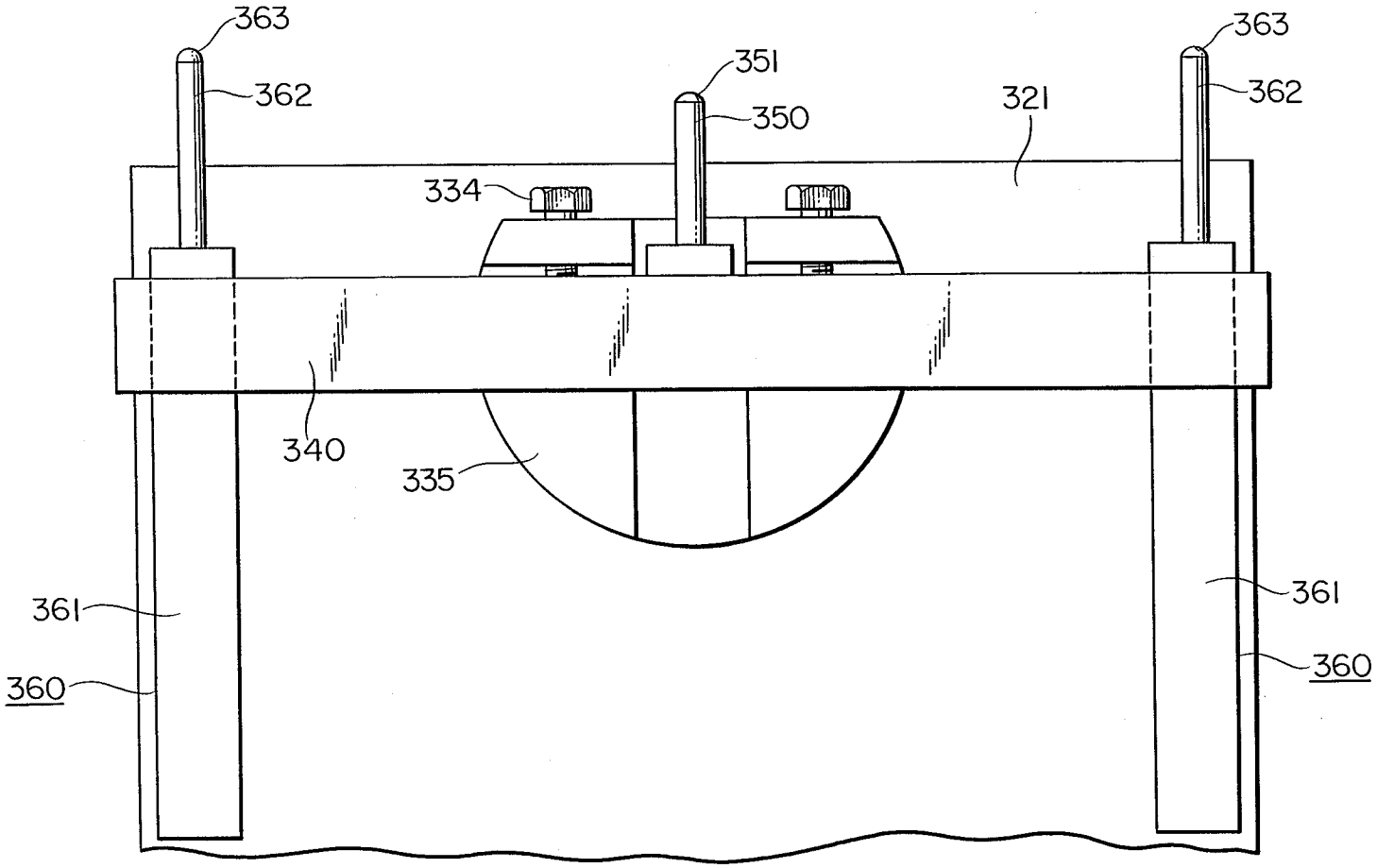
FIG. 5 is an enlarged front elevation similar to FIG. 4 showing the end portion of a curvature measuring unit according to a second embodiment of the present invention.

FIG. 5 illustrates a portion of a second embodiment of a three-roller bending apparatus according to the present invention. Only the top portion of the curvature measuring unit 300 is illustrated, as in all other respects this embodiment is identical to the first embodiment. This embodiment differs from the first in that instead of having one displacement meter 360 disposed between two stationary probes 350 and 355, one stationary probe 350 is disposed midway between two identical displacement meters 360 secured to opposite ends of a probe holder 340. In addition, the rotating jig 330 of FIG. 4 has been replaced by a stationary jig 335 which is rigidly secured to the upper plate 321 of the translating frame 320. Accordingly, the biasing spring 332 and the roller bearing 331 of the first embodiment are not necessary. As with the first embodiment, the displacement meters 360 produce electrical output signals corresponding to the displacements of the two moving probes 362 which are provided to a calculating and display unit 395. In their fully extended positions, the tips of the moving probes 362 should extend farther from the probe holder 340 than the tip of the stationary probe 350.

The operation of this embodiment is similar to that of the first embodiment, except that there is no rotational movement of the jig 335. The ram 371 of the drive cylinder 370 moves the translating frame 320 towards the workpiece 700 until the tips of all three of the probes firmly contact the surface of the workpiece 700. Contact between the stationary probe 350 and the workpiece 700 will prevent the further movement of the translating frame 320, and as described above the ram 371 will continue to extend until the rod 372 contacts and operates the limit switch 380, thereby stopping the motion of the drive cylinder 370. The calculating and display unit 395 will then calculate the curvature of the workpiece 700 based on the electrical input signals from the displacement meters 360, and the calculated curvature will be displayed for the operator.

Although this embodiment requires an additional displacement meter 360, it has the advantage of having a simpler structure than the first embodiment employing a rotating jig 330. Like the first embodiment, it provides automatic and accurate measurement of the curvature of a workpiece without the need for templates.

Figure 6:
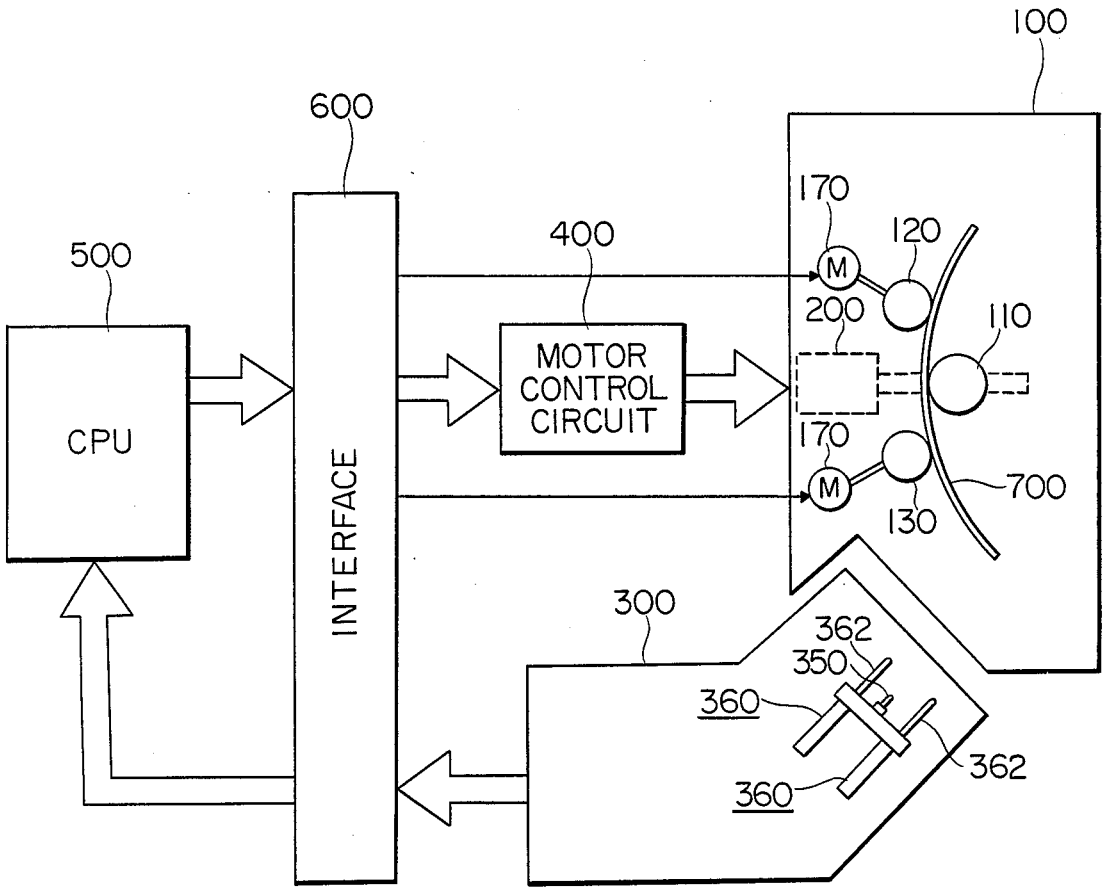
FIG. 6 is a block diagram of a third embodiment of a three-roller bending apparatus according to the present invention.

FIG. 6 is a block diagram of a third embodiment of a three-roll bending apparatus according to the present invention. In addition to the components of the first two embodiments, this embodiment further comprises a motor control circuit 400 which controls the motor 200 for the top roller 110, a CPU 500 which is responsive to the output signal of the displacement meter(s) 360 of the curvature measuring unit 300 and which controls the curvature measuring unit 300, the motor control circuit 400, and the drive motors 170 for the bottom rollers 120 and 130, and an interface 600 electrically connected between the CPU 500 and the parts controlled by the CPU 500.

The curvature measuring unit 300 of this embodiment may be the same as either of those of the previous embodiments except that it does not require a control and display unit 395, the function of which is performed in this embodiment by the CPU 500.

The CPU 500 is a conventional computer having a display and a keyboard or other means with which an operator can input data. The CPU is electrically connected to the displacement meter(s) 360 of the curvature measuring unit 300 so as to receive their electrical output signals through a suitable interface 600. Furthermore, the CPU produces electrical output signals which control the drive cylinder 370, the motor control circuit 400, and the drive motors of the bottom rollers 120 and 130 of the roller portion 100.

Figure 7:
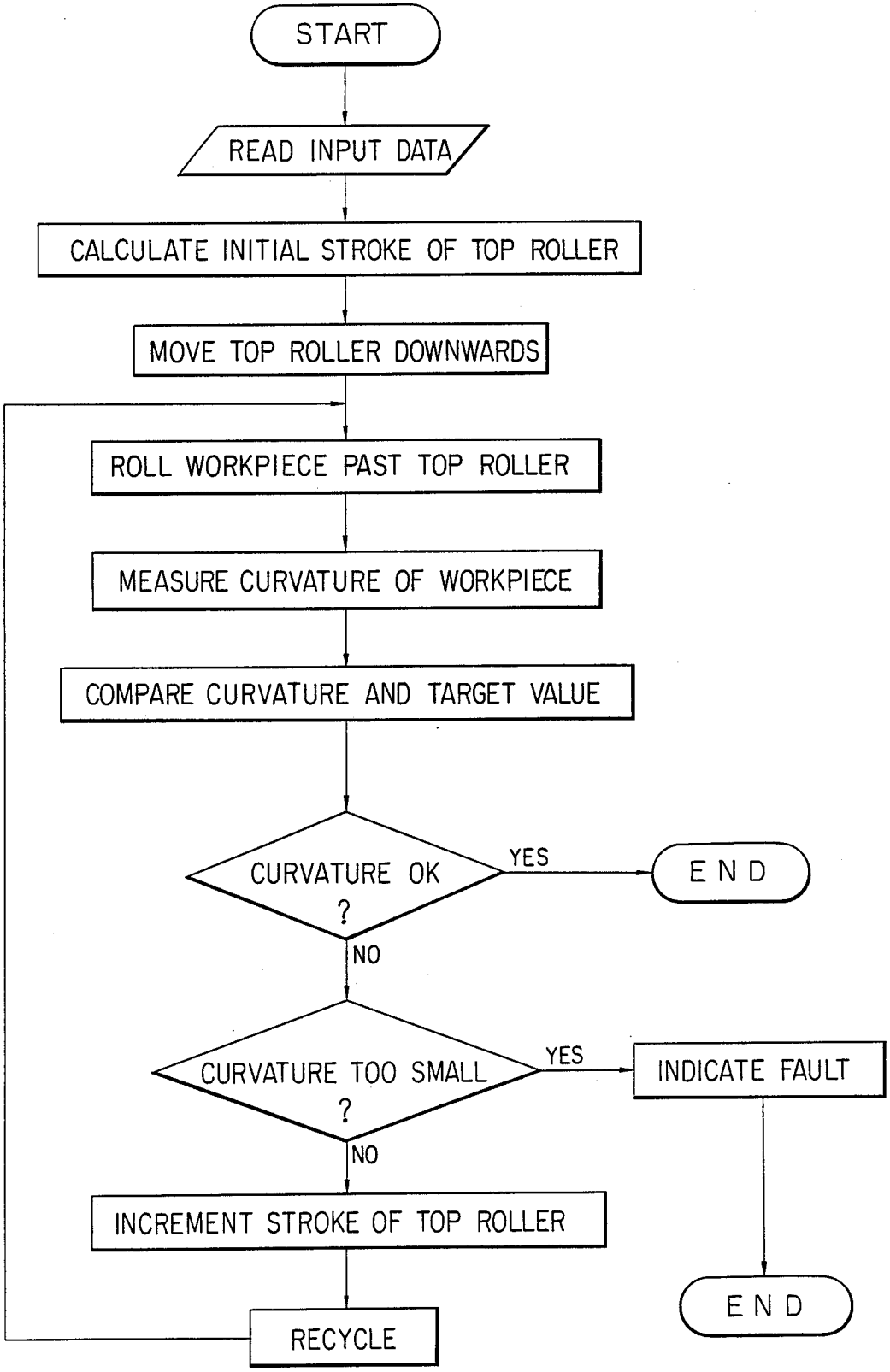
FIG. 7 is a flow chart illustrating the control process performed by the CPU of the embodiment of FIG. 6.

The operation of this embodiment will now be described with the aid of FIG. 7, which is a flow chart of the operations performed by the CPU 500. Prior to the start of rolling, a program for calculating the stroke of the top roller 110 necessary to achieve a desired radius of curvature is stored in the CPU 500. An operator then inputs the cross-sectional dimensions of the workpiece 700 prior to bending, the material constants (Young's modulus and the strain at yield) of the workpiece 700, the desired radius of curvature of the finished workpiece 700, the distance between the rollers, and the radius of each of the rollers into the CPU 500. Using the previously mentioned program, the CPU 500 calculates the stroke of the top roller 110 for the first stage of rolling based on these input values. The CPU 500 then provides an output signal to the motor control circuit 400 via the interface 600, and the motor control circuit 400 operates the motor 200 so as to move the top roller 110 downwards by the amount calculated by the CPU 500, thereby deforming the workpiece 700. When the top roller 110 has been pushed downwards by the suitable amount, the CPU 500 operates the drive motors 170 of the bottom rollers 120 and 130 so as to rotate them clockwise and carry the workpiece 700 to the right in FIG. 6, performing continuous bending. The CPU 500 stops the rotation of the bottom rollers 120 and 130 at the appropriate time so that the workpiece 700 will not become separated from the rollers by being driven too far to the right.

After this first stage of bending is completed, the CPU 500 operates the drive cylinder 370 of the curvature measuring unit 300, and the translating frame 320 is moved upwards in the same manner as described earlier until all of the probes firmly contact the surface of the workpiece 700. The electrical output signals of the displacement meter(s) 360 are input to the CPU 500, which calculates the present curvature of the workpiece in the same manner as the calculating and display unit 395 of the first two embodiments. The CPU 500 then operates the drive cylinder 370 so as to return the translating frame 320 to its original position.

The CPU 500 compares the measured radius of curvature of the workpiece 700 with the desired radius of curvature previously input into the CPU 500. If the measured radius differs from the desired radius of curvature by less than an allowable error, the CPU 500 determines that the degree of bending of the workpiece 700 is satisfactory and the workpiece 700 is automatically removed from the rollers. If the measured radius is smaller than the desired radius by more than the allowable error, the CPU 500 determines that the workpiece 700 has been overbent and is therefore faulty. The workpiece 700 is automatically removed from the apparatus and the CPU 500 indicates to the operator via the display or a warning light that the workpiece 700 is faulty.

If the measured radius is found to be greater than the desired radius by more than the allowable error, then the CPU 500 determines that the workpiece 700 requires a second stage of bending. The CPU 500 then controls the motor control circuit 400 so as to increment the stroke of the top roller 110 by a predetermined amount. The above-described cycle of rolling the workpiece 700 and measuring its radius of curvature is then repeated until the CPU 500 determines that the radius of curvature of the workpiece 700 is satisfactory or else is smaller than permissible.

Next, the principles behind the program used by the CPU 500 for calculating the stroke of the top roll 110 necessary to achieve a desired radius of curvature will be explained with the aid of FIGS. 8 through 12. Explanation will be made with respect to a channel member.

Figure 9:
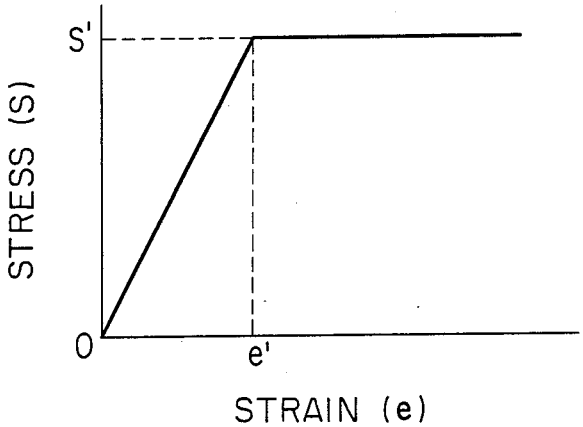
FIG. 9 is a stress-strain diagram showing a simplified model of the relationship between stress and strain for 3-roller bending.

First, it will be assumed that during bending, the relationship between bending stress (S) and strain (e) in a workpiece is expressed by the curve in FIG. 9. Namely, $$S = e \times E \text{ in the elastic region}$$

$$S = S' \text{ in the plastic region} \quad (1)$$

wherein E = Young's modulus and S' = yield stress.

In order to analyze springback, the neutral surface of the workpiece during bending must be found. This can be done by solving the following equation for a transverse cross section of the workpiece 700.

$$\int S dA = 0 \quad (2)$$

wherein dA is an infinitesimal unit of area.

FIG. 8 shows cross sections of channels and the corresponding stress distributions during elasto-plastic bending. As shown in the figure, there are three possible cases depending on the location of the top surface of the groove of the channel with respect to the elastic region. In the figure, a, b, c, and d are the dimensions of the cross section, and h is the distance from the top surface of the channel to its neutral surface. In the stress diagrams, a positive stress indicates tension and a negative stress indicates compression. These three cases will be analyzed below.

Figure 8A:
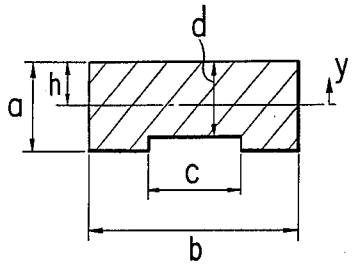
FIGS. 8*a*, 8*b*, and 8*c* are cross-sectional views of different channel members in which the top surface of the groove of the channel lies below, in, and above the elastic region.
Figure 8D:
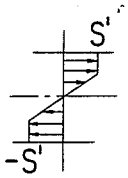
FIGS. 8*d*, 8*e*, and 8*f* are the corresponding stress diagrams.

Case 1: In this case, the top surface of the groove of the channel lies below the elastic region (FIG. 8*a*). Accordingly, the following inequality holds:

$$(h-d)/R \leqq -e' \quad (3)$$

wherein R is the radius of curvature of the neutral surface of the channel during bending, and e' is the strain at yield.

Figure 8B:
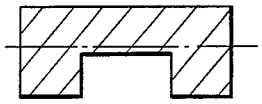
Figure 8E:
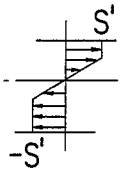

Case 2: In this case, the top surface of the groove of the channel lies within the elastic region (FIG. 8*b*). Accordingly, the following inequality holds:

$$-e' \leqq (h-d)/R \leqq e' \quad (4)$$

Figure 8C:
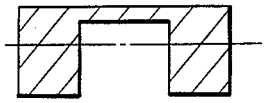
Figure 8F:
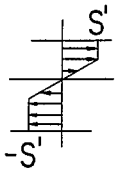

Case 3: In this case the top surface of the groove of the channel lies above the elastic region (FIG. 8*c*). Accordingly, the following inequality holds:

$$(h-d)/R \geqq e' \quad (5)$$

Assuming that the stress-strain relationship is expressed by the curve of FIG. 9, then the position of the neutral surface in each of the above cases can be expressed as follows:

$$\text{Case 1: } h=f1(a,b,c,d)$$
$$\text{Case 2: } h=f2(a,b,c,d,R,e') \quad (6)$$
$$\text{Case 3: } h=f3(a,b,c,d)$$

Next, the bending moment M applied to the channel during bending will be found by solving the following equation.

$$M=\int SydA \quad (7)$$

wherein y is the distance from the neutral surface as shown in FIG. 8. The value of M for each of the above 3 cases can be expressed as follows:

$$\text{Case 1: } M=g1(a,b,c,d,E,e',R)$$
$$\text{Case 2: } M=g2(a,b,c,d,E,e',R) \quad (8)$$
$$\text{Case 3: } M=g3(a,b,c,d,E,e',R)$$

Springback is the phenomenon in which the bending moment M developed during rolling is elastically released. The following equation holds true for springback:

$$M/EI=1/R-1/R2 \quad (9)$$

wherein R is the radius of curvature of the neutral surface of the channel when a bending moment is applied, R2 is the radius of curvature after the bending moment is released, and I is the moment of inertia of the cross-section of the channel.

During springback, the position of the neutral surface is different from the neutral surface during bending, and it is therefore necessary to find the location of the neutral surface using Equation (2).

The purpose of the preceding analysis has been to find the radius of curvature R during bending given a target value for the radius of curvature of the finished article, i.e., R2, the radius of curvature after the bending moment is removed. This can be done by substituting Equations (6) and (8) into Equation (9). Upon doing so, for Case 1 and Case 3, a cubic expression is obtained having R as a variable. By solving these cubic expressions, the appropriate value of R can be found for a given value of R2 for each case. These cubic expressions can be solved by a computer using an iterative method such as the Newton-Raphson Method. Because R is included in Equation (6) for Case 2, a higher order equation is obtained. However, in this case as well, R can be solved for by a similar iterative method.

Thus, if the cross-sectional shape, the material constants, the distance between the rollers, the radius of each roller, and the desired radius of curvature are input into a computer, the suitable radius of curvature of the neutral surface of the channel during bending can be found.

However, it is still necessary to know the size of the stroke of the top roller of the bending apparatus, i.e., the deformation of the workpiece 700 which must be applied by the top roller 110 in order to obtain the radius of curvature solved for above. A method of analysis for determining the appropriate stroke size will now be described.

Figure 10:
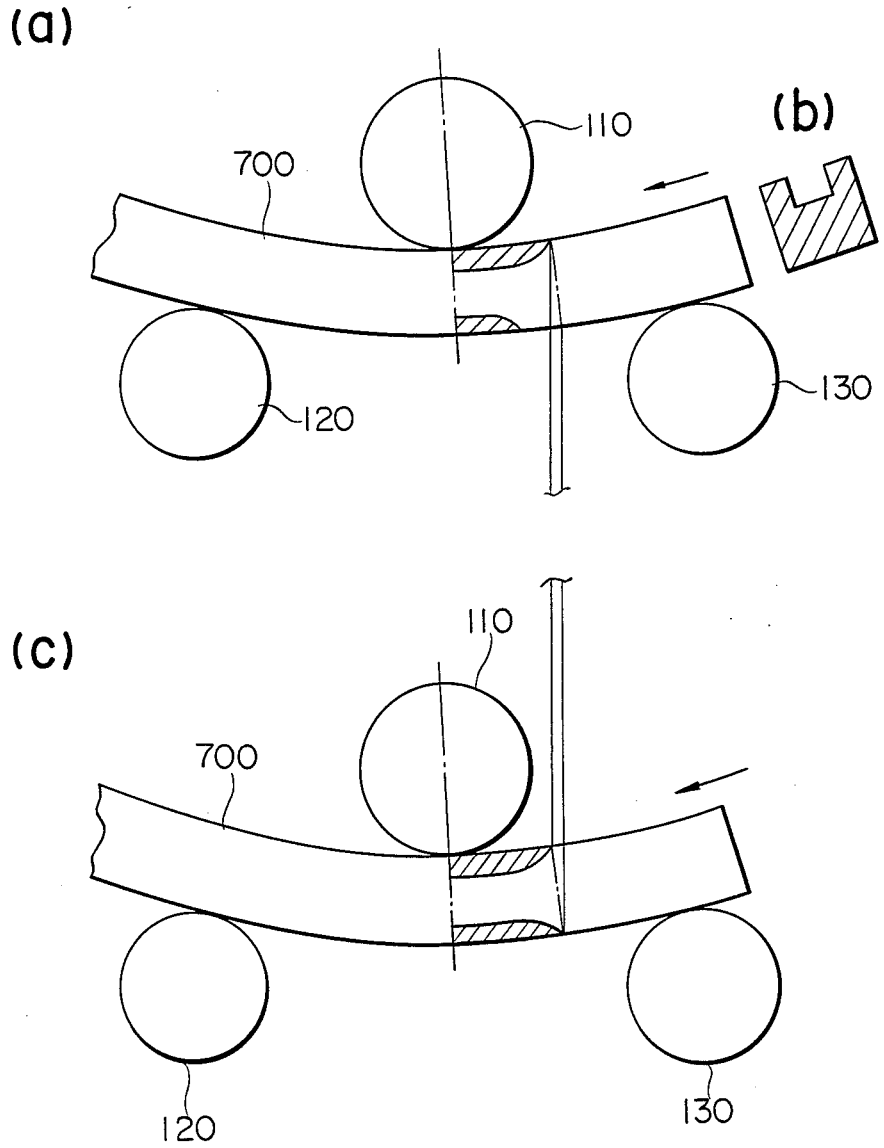
FIGS. 10*a* and 10*c* are schematic views showing the actual and assumed locations of the plastic regions in a channel member being bent by three-roller bending.
FIG. 10*b* is a cross-sectional view of the channel member.

FIG. 10 schematically shows the deformed state of a workpiece 700 between the rollers of a three-roll bending apparatus. The workpiece 700 is a channel having a cross-sectional shape as shown in FIG. 10*b*.

The workpiece 700 begins to undergo bending deformation upon passing to the left of the point of contact with the right-hand bottom roller 130, and the magnitude of the deformation increases as it approaches the top roller 110, and finally plastic deformation, indicated by hatching, occurs. After the workpiece 700 passes the top roller 110, the bending moment applied to the workpiece 700 gradually decreases, and springback occurs. The springback continues until the workpiece 700 reaches the left-hand bottom roller 120, after which there is no further deformation of the workpiece 700. Since the neutral surface does not lie halfway along the depth of the workpiece 700, the points at which plastic deformation commence (the right-hand ends of the hatched areas) are different for the upper and lower surfaces of the workpiece 700, as shown in FIG. 10*a*. However, for the sake of simplicity, it has been assumed that the points at which plastic deformation begin are the same for the top and bottom surface of the workpiece 700, as shown in FIG. 10*c*.

Figure 11:
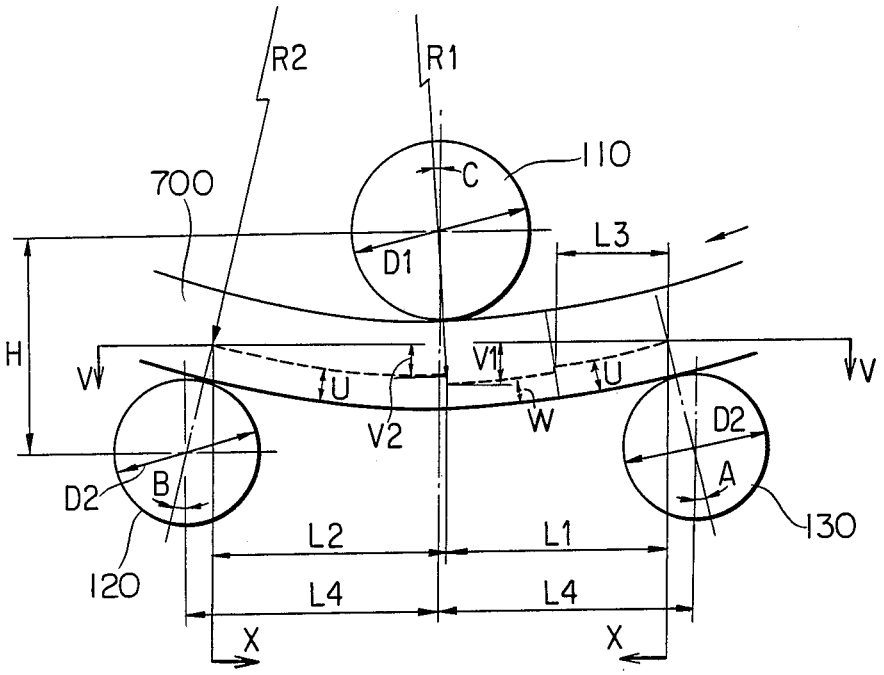
FIG. 11 is a schematic view of a workpiece being bent by three-roller bending illustrating the location of the neutral surface during bending.

FIG. 11 shows the location of the neutral surface of the workpiece 700 during bending, indicated by the dashed line. The distance measured along the horizontal from the intersection between the neutral surface of the workpiece 700 and the line passing through the center of one of the bottom rollers and the point of contact between the bottom roller and the workpiece 700 is indicated by x, while v indicates the distance measured along the vertical between the above intersection and the neutral surface, and therefore v indicates the vertical deflection of the workpiece 700 between the rollers. A, B, and C indicate the angles between the vertical and the points of contact between the workpiece 700 and the rollers 130, 120, and 110, respectively. H indicates the vertical distance between the center of the top roller 110 and the centers of the bottom rollers. L1 and L2 are the values of x for the bottom rollers 130 and 120, respectively, measured to the intersection of the neutral surface of the workpiece 700 and a line extending from the center of the top roller 110 through the point of contact between the workpiece 700 and the top roller 110, L3 is the value of x for the right-hand bottom roller 130 measured to the point at which plastic deformation begins, and L4 is the horizontal distance between the center of the top roller 110 and the center of either of the bottom rollers. V1 and V2 are the values of V on the entrance side and the exit side, respectively, at the above-described intersection of the neutral surface and a line from the center of the top roller 110 passing through the point of contact between the top roller 110 and the workpiece 700. D1 is the diameter of the top roller 110 and D2 is the diameter of either of the bottom rollers. R1 is the radius of curvature of the neutral surface of the workpiece 700 at the above-described intersection of the neutral surface and a line from the center of the top roller 110 passing through the point of contact with the top roller 110 i.e. the loaded radius, and R2 is the radius of curvature at the above-described intersection of the neutral surface and a line from the center of the top roller 110 passing through the point of contact with the left-hand bottom roller 120, which is the final radius of curvature of the workpiece 700 after springback occurs. Furthermore, U is the distance in the radial direction from the neutral surface of the workpiece 700 to the outer surface on the input and output sides where elastic deformation (including springback) takes place, and W is the distance in the radial direction from the neutral surface to the outer surface of the workpiece 700 where plastic deformation takes place.

There are 9 unknown values: H, A, B, C, L1, L2, V1, V2, and L3. Of these, L3 can be found by solving for the location at which the strain in the top surface of the workpiece 700 just equals the strain at yield while all portions of the cross section at this location are still in the elastic region. The remaining 8 values are solved for by first assuming that on the entrance side of the top roller 110 the workpiece 700 can be treated as a cantilever beam and that on the exit side of the top roller 110 springback of the workpiece 700 progresses. Below, the analysis for the entrance side and the exit side will be separately explained.

(1) Entrance Side

Figure 12:
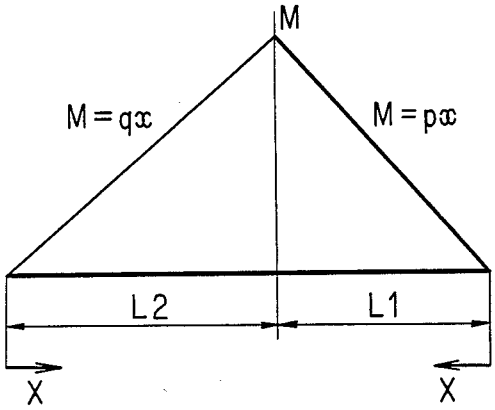
FIG. 12 is a simplified bending moment diagram representing the bending moment of the portion of the workpiece of FIG. 11 located between the rollers.

The basic equations defining the shape of the workpiece 700 are $$d^2v/dx^2 = -1/R \tag{10}$$

$$\tan(z) = dv/dx \tag{11}$$

wherein z is the angle of slope of the neutral surface of the workpiece 700 with respect to the horizontal and R is the radius of curvature. In the elastic region, 1/R of Equation 10 can be replaced by M/EI. Furthermore, in the plastic region, Equation 8 can be solved for R, and if the bending moment between the rollers is assumed to have a linear distribution such as shown in FIG. 12, then M can be replaced by px, where p is the slope of the right half of the bending moment diagram. Accordingly, the right side of Equation 10 can be expressed in terms of x.

The following boundary conditions will be assumed:

at x=0, z=A and v=0;

at x=L3, the deflection and angle of slope of the workpiece are continuous; and at $x=L1$, $d^2v/dx^2=-1/R1$, $z=C$, and $v=V1$.

By solving Equations 10 and 11, an equation for deflection and an equation for angle of slope is obtained for each case. Furthermore, from geometric considerations, the following two equations are obtained for each case:

$$L1+(D1/2+a-w)\sin C+(D2/2+u)\sin A=L4 \tag{12}$$

$$V1+H=(D1/2+a-w)\cos C+(D2/2+u)\cos A \tag{13}$$

(2) Exit Side

On the exit side, springback continually progresses between the top roller 110 and the left-hand roller 120. Accordingly, since the relationship between R and M is expressed by M/EI=1/R−1/R2 (Equation 9) and M is assumed to equal qx as shown in FIG. 12, the right side of Equation 10 can be expressed in terms of x.

The boundary conditions for the exit side are as follows:

at x=0, z=B and v=0 at x=L2, z=−C and v=V2

By solving Equations 10 and 11, an equation for deflection and an equation for angle of slope is obtained for each case. Furthermore, geometric considerations give equations like Equations 12 and 13 for each case.

Thus, for the 8 unknowns H, A, B, C, L1, L2, V, and V2, there are obtained 8 equations, including Equations 12 and 13. These equations are non-linear in form, but the equations can be solved by an iterative method such as the Newton-Raphson Method to give the value of H, which is the required vertical distance between the top roller 110 and the bottom rollers in order to give the desired radius of curvature. Given H, the stroke of the top roller 110 can immediately be found.

Figure 13:
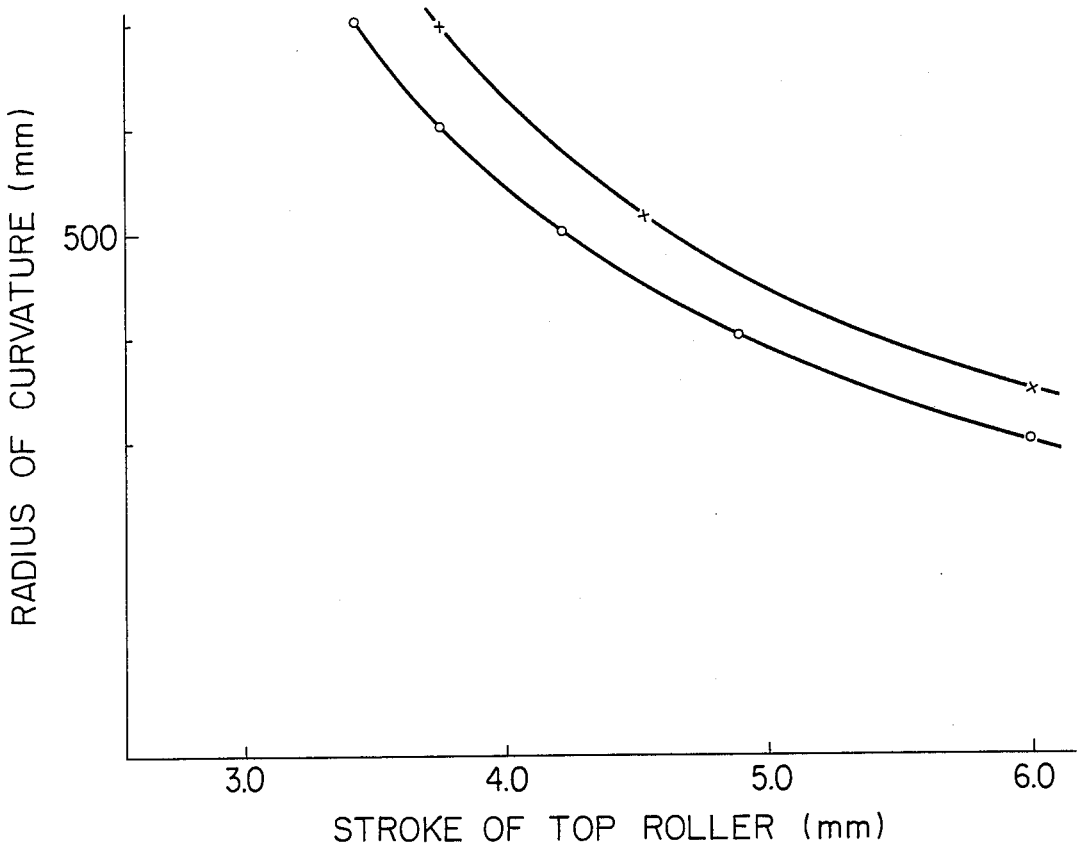
FIG. 13 is a graph showing calculated values (lower curve) of the radius of curvature of a copper-silver workpiece as a function of the stroke of the top roller of a three-roller bending apparatus and experimentally determined values (upper curve) for the same material.

FIG. 13 is a graph comparing the results of numerical analysis performed in the above manner with actually measured values for the relationship between the size of the stroke of the top roller of a three-roller bending apparatus and the resulting radius of curvature of the workpiece, both measured in millimeters. The top curve shows measured values, and the bottom curve shows calculated values. The workpiece was a copper-silver cold drawn having a Young's modulus of 10,700 kgf/mm$^2$ and a strain at yield of 0.00264 formed into the shape of a channel like that shown in FIG. 8 with a=9.74 mm, b=45 mm, c=30mm, and d=4.9 mm. The x-axis is the deflection of the neutral surface of the channel in mm, or in other words the size of the stroke of the top roller. Although the calculated values lie below the measured values, the difference between the two is fairly constant for the entire range of the curves. Therefore, if a correction factor is added to the calculated value, the necessary stroke of the top roller can be predicted with considerable accuracy. In actual processing, it is advisable to set the stroke of the top roller somewhat low in order to prevent overbending of the workpiece.

Using the above-described method of analysis, it is possible for the CPU 500 of the embodiment shown in FIG. 6 to calculate the stroke of the top roller 110 and control it accordingly, making it possible to perform much more accurate bending than with a conventional apparatus in which the size of the stroke of the top roller is determined by an operator relying only on his experience and intuition.

Figure 14:
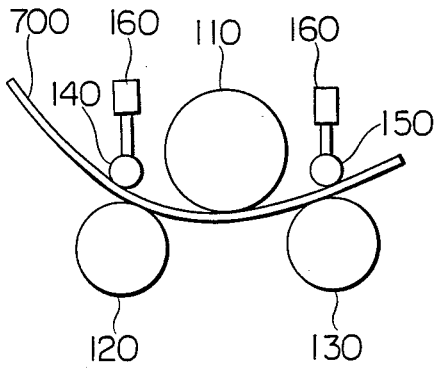
FIG. 14 is a schematic view of another embodiment of the present invention, in which auxiliary rollers are provided above the bottom rollers.

FIG. 14 shows a front view of the roller portion of a three-roll bending apparatus according to a fourth embodiment of the present invention. The other portions of the apparatus are identical to those in any one of the first three embodiments and are therefore not illustrated. In this fourth embodiment, two auxiliary rollers 140 and 150 are provided so as to confront the bottom rollers 120 and 130, respectively, and to press the workpiece 700 against the bottom rollers. Each of the auxiliary rollers can be moved vertically towards and away from the bottom rollers 120 and 130 by a drive cylinder 160 operated pneumatically, hydraulically, or electrically.

As explained earlier, in a conventional three-roll bending apparatus, a small gap may develop between the top roller and the workpiece due to the fact that the end portions of the workpiece are not bent but remain straight during rolling. Unless the top roller contacts the workpiece, the bottom rollers in a conventional apparatus are unable to transport the workpiece. Therefore, it is necessary to increase the stroke of the top roller until it contacts the workpiece. While this makes it possible for the bottom rollers to move the workpiece, the increase in the stroke of the top roller may produce overbending of the workpiece and making it unsuitable for use.

However, in the embodiment illustrated in FIG. 14, the drive cylinders 160 press the auxiliary rollers 140 and 150 against the workpiece 700, and the auxiliary rollers 140 and 150 in turn press the workpiece 700 against the bottom rollers 120 and 130, respectively, making it possible for the bottom rollers to move the workpiece 700 even if there is a gap between the workpiece and the top roller 110. The auxiliary rollers 140 and 150 do not require drive motors to rotate them but act as followers which rotate due to the movement of the workpiece 700 by the bottom rollers 120 and 130. The forces which the drive cylinders 160 exert on the auxiliary rollers 140 and 150 need not be large.

During the first stage of rolling in which the workpiece 700 is initially bent, it is usually not necessary to apply the auxiliary rollers 140 and 150 to the workpiece 700, as gaps between the workpiece 700 and the top roller 110 normally do not develop until the second stage of rolling. However, if a small force is exerted by the drive cylinders 160, the auxiliary rollers 140 and 150 may be applied during the first stage of rolling as well.

The operation of this embodiment is otherwise the same as that of the first three embodiments and will not be described in further detail. In addition to providing the benefits of the previous embodiments, it provides the further advantage that it is not necessary to increase the stroke of the top roller 110 in order to enable the bottom rollers 120 and 130 to move the workpiece 700, and therefore overbending of the workpiece 700 is less likely to occur.

The embodiment of FIG. 14 employs two auxiliary rollers to press the workpiece 700 against the bottom rollers. However, a single auxiliary roller confronting either one of the bottom rollers can also be used effectively to achieve the same result.

Although the present invention was described with respect to a pyramid-type three-roller bending apparatus, there is no particular limitation on the disposition of the rollers, and the present invention can also be used as a shoe-type three-roller bending apparatus or a pinch-type three-roller bending apparatus or even as a four-roller bending apparatus.

Furthermore, although the operation of the apparatus was explained which respect to the rolling of a channel member, it can of course also be used for the rolling of tees, plates, sheets, square and rectangular bars, and other shapes.

What is claimed is:

1. A roller bending apparatus comprising:

a top roller;

two or more bottom rollers disposed below said top roller, said top roller located horizontally in a space between two of the bottom rollers, for supporting a workpiece;

means for moving said top roller vertically over the length of a stroke;

a drive motor connected to said bottom rollers so as to rotate said bottom rollers forward or backward;

means for measuring a radius of curvature of the workpiece and for producing a corresponding output signal, said measuring means including a frame movable toward and away from the workpiece along a straight line perpendicular to a tangent of said workpiece, a probe holder on said frame, two coplanar stationary probes secured to opposite ends of said probe holder, displacing means including a movable probe for producing said output signal upon linear displacement of said movable probe when said stationary probes are in contact with said workpiece, said displacing means being secured to said probe holder between said stationary probes in the same plane as said stationary probes, and power means for moving said frame and probe holder toward and away from said workpiece such that said probes are movable into contact with said workpiece and are separable from said workpiece;

said power means including a drive cylinder for generating a force responsive to an electrical input signal, a ram connected to said cylinder and movable responsive to said force, a guide plate rigidly mounted on said frame and having a journal bearing formed in the center thereof, a rod slidable through and supported by said journal bearing and including a limit rigidly secured to an outer end for preventing said rod from passing through said guide plate and a compression spring concentrically disposed around another outer end to cause said frame to move along an axial direction when said ram is moved outwardly by said force, and a limit switch rigidly secured in the vicinity of said guide plate on said frame and electrically connected to said drive cylinder to stop said drive cylinder from generating said force when contacted by said rod;

control means including calculating means and connected to receive the output signal of said curvature measuring means and operable under program control for determining an elastoplastic bending moment to be applied to said workpiece, said calculating means including means for determining the radius of curvature of said workpiece based on said output signal, means for calculating a first radius of curvature for a first neutral surface of the workpiece during bending of the workpiece which will result in a desired second radius of curvature for a second neutral surface corresponding to the desired radius of curvature of the workpiece after release and springback of the workpiece, and means for calculating the vertical stroke length said top roller must be moved to achieve said first radius of curvature during bending, said control means further including means for controlling said moving means to move said top roller in accordance with said stroke length, and means for controlling said drive motor for said bottom rollers to roll said workpiece through said rollers and stop said workpiece in said rollers, and to repeat the rolling if the difference between the determined radius of curvature and the desired radius of curvature is greater than a certain value, and for ending rolling if the difference is less than a certain value.

* * * * *